US005698808A

United States Patent [19]

Hamlin

[11] Patent Number: 5,698,808

[45] Date of Patent: Dec. 16, 1997

[54] ELECTRONIC GUITAR HAVING POWER CONDUCTING PICK

[76] Inventor: Randall L. Hamlin, 957 Country La., Indianapolis, Ind. 46217

[21] Appl. No.: 647,313

[22] Filed: May 9, 1996

[51] Int. Cl.[6] ..... G10H 1/18

[52] U.S. Cl. ..... 84/722; 84/DIG. 30

[58] Field of Search ..... 84/646, 722–728, 84/731, 733–742, 320–322, DIG. 30

[56] References Cited

U.S. PATENT DOCUMENTS

| | | | |
|---|---|---|---|
| 3,544,696 | 12/1970 | Broussard . | |
| 4,078,464 | 3/1978 | Sugiyama . | |
| 4,372,187 | 2/1983 | Berg . | |
| 4,658,690 | 4/1987 | Aitken et al. | 84/DIG. 30 |
| 4,919,033 | 4/1990 | Markov et al. . | |
| 4,966,052 | 10/1990 | Shiraki et al. . | |
| 5,033,351 | 7/1991 | Nomura . | |
| 5,300,730 | 4/1994 | Ekhaus | 84/320 X |

FOREIGN PATENT DOCUMENTS

| | | |
|---|---|---|
| 0173006 | 3/1986 | European Pat. Off. . |
| 2924381 | 2/1981 | Germany . |

*Primary Examiner*—Stanley J. Witkowski

*Attorney, Agent, or Firm*—Terrance L. Siemens

[57] ABSTRACT

An electronic stringed instrument which simulates an acoustic counterpart, such as a guitar, in the aspect of string arrangement. The strings on the novel electronic instrument are actually depressed and picked in a manner similar to playing the acoustic counterpart to sound musical tones. The strings form partial circuits conducting signals to a conventional musical tone synthesizer. The pick completes the circuit for each tone, having a flexible conductor electrically joining the pick to each circuit. A complete signalling circuit for each tone is closed when the string is contacted by the pick, and when the string simultaneously contacts an electrically conductive terminal forming part of the circuit. Contact of the string is achieved either by depressing the string or by leaving the string undisturbed. In each instance, a signal will sound a tone corresponding to that which would ensue if the same actions were taken on the acoustic counterpart.

7 Claims, 4 Drawing Sheets

ELECTRONIC GUITAR HAVING POWER CONDUCTING PICK

BACKGROUND OF THE INVENTION

1. Field of the Invention

The present invention relates to an electronic guitar having strings and a pick which are employed in the manner of conventional acoustic guitars. The pick and strings complete circuits generating signals representative of tones which would result from the conventional guitar responsive to similar play. The signals are transmitted to a conventional musical tone synthesizer for generating musical tones responsive to depressing and picking the strings.

2. Description of the Prior Art

Electronic instruments generally and guitars in particular are well known. These instruments generate sounds indirectly, generally requiring that a player depress push-buttons of switches for generating control signals subsequently employed to generate or synthesize desired musical tones. There is no requirement that music synthesizers simulate acoustic instruments, although this feature is frequently desired for purposes of suggesting verisimilitude.

German Pat. Application No. DE 2,924,381A1, dated Feb. 19, 1981, describes a dual purpose electrically amplified guitar. The guitar generates notes directly by conventional strings, and has pickups for transmitting a generated tone to an amplifier for subsequent reproduction of the tone. In addition to this conventional construction, the guitar has mechanically operated switches disposed beneath each string, between adjacent frets, so that depression of a string also depresses the switch operator. The switch completes a circuit activating a remote tone generator in the form of an electronic organ. This invention enables music to be generated by operation as an ordinary electric guitar, as a controller for the organ, in which case guitar strings are depressed but not plucked, or by both guitar and organ simultaneously.

Strings in the present invention are arranged to complete electrical signalling circuits, and therefore have structure different from those of the German device. Electrical signalling contact arises not from depression of a switch, as in the German device, but by the act of picking the strings. This is so because the pick is energized, and forms part of the circuit. The mechanically operated switches of the German device are absent in the present invention.

E.P.O. Pat. Application No. 0,173,006, published on Mar. 5, 1986, describes an electronic musical instrument generally simulating a guitar, and having strings and frets. However, the circuits of this device fail to include a pick which is required in the present invention for completing a signal circuit for generating a tone. Also, the frets of the device of the E.P.O. Application are conductive, and are formed in segments to avoid shorting. By contrast, the frets of the present invention are not conductive, and serve merely to elevate the strings out of electrical contact with conductors disposed beneath each string.

U.S. Pat. No. 4,372,187, issued to Arne L. Berg on Feb. 8, 1983, an electronic guitar is described which has abilities to modify selected tones. The device of Berg lacks the conductive pick of the present invention for closing circuits. The Berg device relies upon induced signals developed in pickup coils associated with permanent magnets located proximate the strings. The present invention is not arranged to induce signals by coils and magnets disposed in proximity to the strings.

U.S. Pat. No. 4,966,052, issued to Kazuyoshi Shiraki et al. on Oct. 30, 1990, describes an electronic musical instrument having apparatus for discriminating root and type of a chord. Structure of circuitry for sounding tones is not critical in the device of Shiraki et al. By contrast, the present invention sets forth a circuit employing a pick as part of the actuating circuit for each tone. Also, structure of the strings and nature of electrical contact arrangement is not taught in the device of Shiraki et al.

It will be noted that the above cited prior art devices fail to require a two step operation to sound a tone. That is, whereas the present invention requires that a string be both depressed and picked or plucked, the prior art devices require only one of these actions. The prior art devices are arranged to complete a tone signalling circuit at a single point of circuit closure, whereas the present invention requires two points to be closed simultaneously.

None of the above inventions and patents, taken either singly or in combination, is seen to describe the instant invention as claimed.

SUMMARY OF THE INVENTION

The present invention provides a musical tone synthesizing instrument which simulates an acoustic stringed instrument both visually and in method of playing. Depression of strings to alter note characteristics causes different electrical circuits to be completed, each circuit corresponding to an actual tone which would be generated by identical manipulation of an acoustic guitar. The circuit is fully completed and energized by picking the selected string with an electrically conductive and energized pick.

This is different from most electronic music synthesizing instruments in that it requires both depression of one element, but also picking of the strings. In prior art devices, even those that would simulate an actual stringed instrument, depression of an element is required to close a signalling circuit, but no picking of a string is also required.

The novel arrangement also differs from electrically amplified guitars wherein the ultimate source of sound is the string itself. In electrically amplified guitars, an inductive pickup receives an input from vibration of the string, and transmits a corresponding signal for subsequent amplification. In the present invention, the string merely completes a circuit, but does not vibrate sufficiently to generate a tone. Rather, tone generation is accomplished by a conventional electronic synthesizer.

It will also be appreciated that similar tones may be generated in guitars by appropriate manipulation of different strings. The same characteristic is maintained in the present invention by providing appropriate tone signalling circuits. This characteristic is usually absent in music synthesizing instruments, since prior art devices are designed for minimal complication and construction elements.

It is contemplated that the novel instrument will simulate a guitar, but could also be patterned after a banjo, lute, or any other stringed instrument having frets for altering effective length and consequent frequency of string vibration. The familiar characteristic of depressing a string maintained under tension is retained. The portion of the string which is plucked need not be under similar tension, but is maintained sufficiently taut as to resist excessive squirm or displacement when picked.

In summary, the present invention differs from prior art electrical and electronic instruments by requiring two steps to generate a tone rather than one. The two steps include depression of a string, and picking of that string.

A number of advantages result from the present arrangement. One is that the novel instrument closely simulates a conventional stringed instrument. Therefore, a musician accustomed to an acoustic guitar need not familiarize himself with a new or different layout in order to play a music synthesizing instrument simulating a guitar. Another advantage is that a person learning to play on the novel instrument can easily transfer his or her skills to an acoustic guitar.

The role of the strings is such that certain differences from and advantages over acoustic instruments arise. One difference is that frets may be equally spaced from one another, rather than be variably spaced, as occurs in acoustic instruments. As a result, more frets may be provided, if desired. Also, fret spacing may be arranged for optimal ergonometric arrangement. Another difference is that the neck and head need not be arranged at a slight angle to the strings, as is practiced in acoustic instruments.

Accordingly, it is a principal object of the invention to provide a music synthesizing instrument which simulates an acoustic stringed instrument.

It is another object of the invention to provide in a music synthesizing instrument tone signalling circuits requiring both depression of a string and picking of that string.

It is a further object of the invention that the string provide an electrically conductive path for completing tone signalling circuits.

Still another object of the invention is to employ frets for depressing strings in the manner of acoustic instruments having frets for altering string vibration characteristics.

An additional object of the invention is to employ conventional musical tone synthesizing apparatus.

It is again an object of the invention that strings which are depressed be maintained under tension resisting depression.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
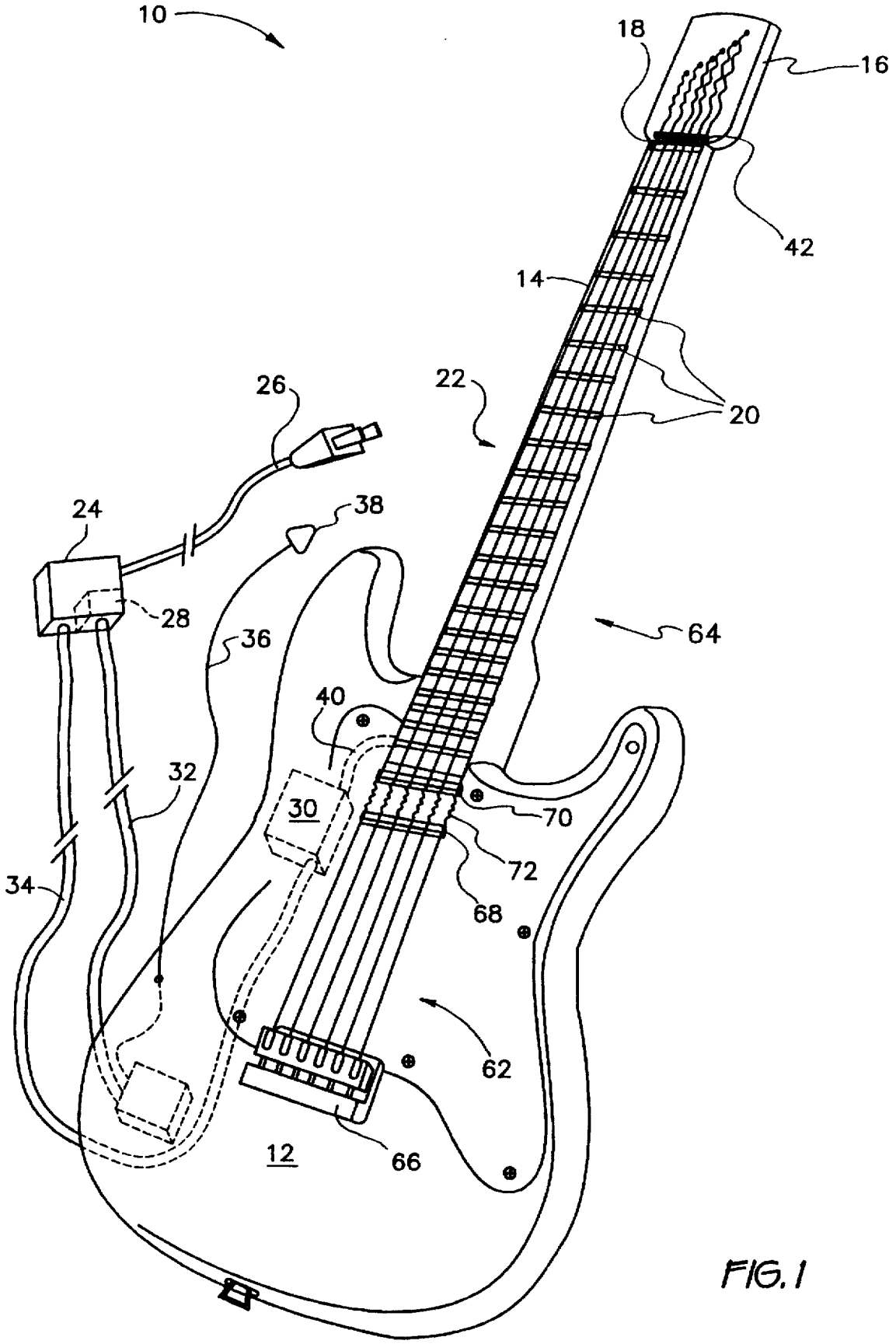
FIG. 1 is a top plan diagrammatic view of a musical instrument according to the present invention.

Turning now to FIG. 1 of the drawings, the novel electronic stringed instrument 10 is seen to have conventional features simulating those of an acoustic guitar (not shown) which is a model for or counterpart of instrument 10. These features include a body 12 including a neck 14 projecting from body 12. Neck 14 has a head 16, a nut 18, and a plurality of fret bars 20 spaced apart from one another. Instrument 10 also has a plurality of strings 22 which are arranged to simulate those of the acoustic counterpart of instrument 10 in that they extend along neck 14 and across fret bars 20 in spaced apart relationship.

Instrument 10 also has a power source 24 of any suitable type. As depicted, power source 24 includes a plug and cord assembly 26 for connection to household AC power, and a converter 28 for providing DC power of reduced voltage for signalling. Power source 24 provides power for a musical tone synthesizer 30 of well known type for generating diverse musical tones individually, responsive to different electrical signals, each signal corresponding to a predetermined individual tone.

The components of instrument 10 presented thus far are generally conventional, being found in electronic instruments, their acoustic counterparts, or both, and will not be set forth in greater detail. Novelty lies in arrangement of strings 22 and switching of an actuating circuit for generating different signals corresponding to the predetermined musical tones of synthesizer 30, and, of course, to tones of an actual acoustic guitar.

The actuating circuit is electrically connected to power source 24 and to synthesizer 30 by conductors 32, 34. The actuating circuit may be regarded as comprising a primary partial circuit deriving power from conductor 32, and having a flexible electrical conductor 36 disposed outside body 12. Conductor 36 connects a pick 38 to power. Pick 38 is fabricated from an electrically conductive material, such as metal.

The primary partial circuit complements a plurality of secondary partial circuits indicated collectively at 40. When electrically energized by closure of both the primary and secondary circuit, each secondary partial circuit will transmit an electrical signal corresponding to an individual musical tone to synthesizer 30.

Switching of a complete signalling circuit for sounding a tone requires two simultaneous electrical circuit closures. First, pick 38 must contact a string 20. Secondly, the contacted string 20 must make electrical contact with a conductive contact of a secondary partial circuit disposed within neck 14. A complete signalling circuit comprises the primary partial circuit and one secondary partial circuit, when contact is made by pick 38 as described and by a string 20 with a contact of one secondary partial circuit.

Strings 22 are electrically conductive, so that mere contact by pick 38 satisfies closure of the primary partial circuit. The second closure may occur in either one of two ways. Bearing in mind that instrument 10 is intended to simulate an acoustic counterpart, it will be recalled that to pluck any one string will sound a tone in the acoustic instrument. To simulate this feature, each string 22 is normally in electrical contact with a secondary partial circuit by virtue of contact of string 22 with an associated secondary partial circuit. This contact occurs at contact blocks 42, there being one block 42 for each string 22. Contact blocks are electrically conductive, and are separated or electrically isolated from one another.

A consequence of conductivity of strings 22 is that inadvertent contact with a fret bar 20 by a string 22 which is not being intentionally picked may sound an unintended tone. To prevent incidental contact from sounding unintended tones, fret bars 20 are preferably electrically insulated or non-conductive.

Figure 2:
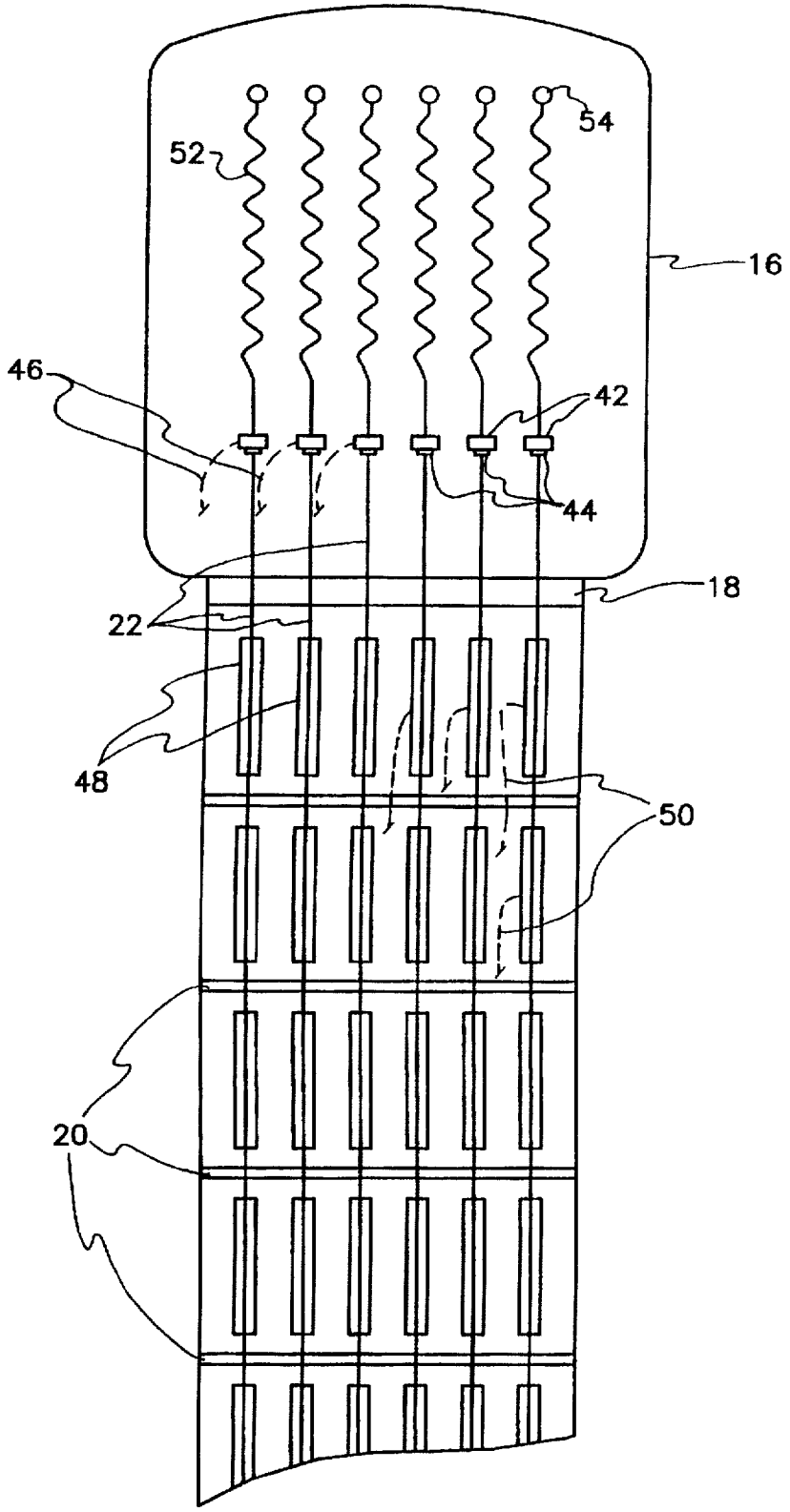
FIG. 2 is a top plan detail view of components seen at the right of FIG. 1, drawn to enlarged scale.

Components of the secondary partial circuits are shown in greater detail in FIG. 2. In this view, all strings 22 are relaxed, in that they are not being depressed, which would have the effect of stretching each depressed string 22. Complementary contact blocks 44 fixed solidly to each string 22 are seen abutting their associated contact blocks 42. If a string is not depressed, then a secondary partial circuit 46 is energized, thereby sounding a tone corresponding to a natural tone of the corresponding string of the acoustic counterpart to instrument 10.

FIG. 2 also shows electrical contact members 48. Each contact member 48 is electrically conductive, is disposed beneath a string 22 between two adjacent fret bars 20, and is electrically connected to an associated secondary partial circuit 50.

Anchorage of strings 22 at head 16 is also shown. Each string 22 has a spring section 52 for maintaining tension, and a point of anchorage, indicated at 54. Spring tension maintains each string in a mildly taut condition such that it will not droop, thereby contacting a contact member 48. Also, tension enhances simulation of the feel of a string of the acoustic counterpart of instrument 10.

Figure 3:
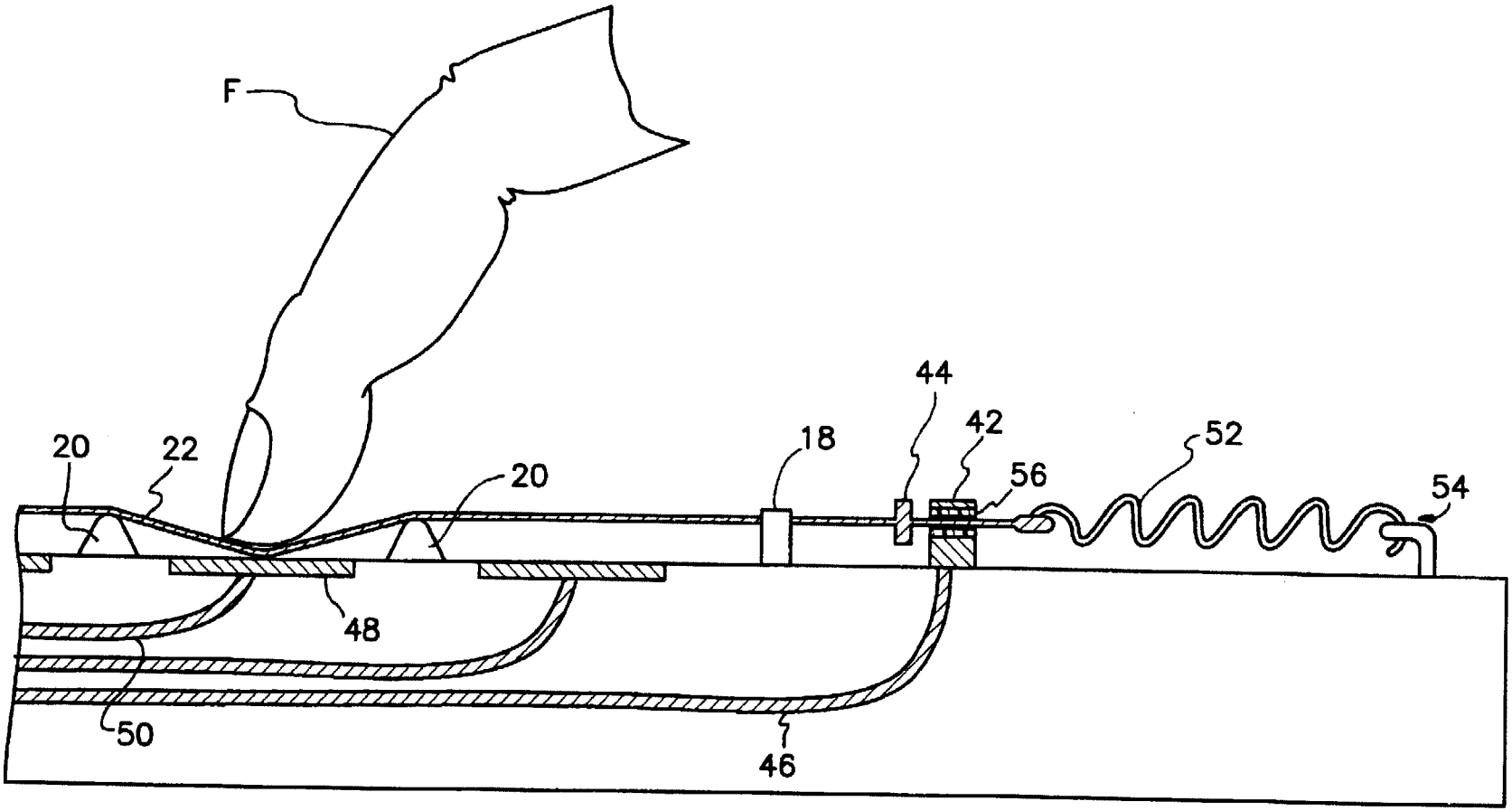
FIG. 3 is an environmental, side elevational view of components shown in FIG. 2, drawn to enlarged scale.

Should a string 22 be depressed in order to modify its resonant frequency, as is conventionally performed in the acoustic counterpart, a switching result will ensue which differs from picking a relaxed string 22. With reference to FIG. 3, a person's finger F is shown depressing a string 22 between adjacent fret bars 20. It will be noted that complementary contact block 44 of the depressed string 22 has been drawn out of abutment with contact block 42. Unintended contact of depressed string 22 with contact block 42 is prevented by an insulating bushing 56. Therefore, secondary partial circuit 46 is not energized even if pick 38 (see FIG. 1) is contacting the depressed string 22.

Instead, a different secondary partial circuit is energized when pick 38 contacts the depressed string 22. This is because string 22 will make electrical connection at contact member 48 responsive to depression. The associated secondary partial circuit 50 will be energized, and will signal synthesizer 30 to sound a tone corresponding to that which would occur if a corresponding string of the acoustic counterpart of instrument 10 were depressed and picked as described in the discussion of FIG. 3. All other secondary partial circuits will remain dormant.

In summary, each contact block 42 and each contact member 48 has an associated secondary partial circuit isolated from every other secondary partial circuit. Each secondary partial circuit has a conductor communicating electrically between its associated contact block 42 or contact member 48 and synthesizer 30 (see FIG. 1), so as to cause synthesizer 30 to sound a predetermined tone peculiar to the closed circuit.

Each partial circuit 46 or 50 is disposed serially with one string 22 such that when that string 22 is depressed between two adjacent fret bars 20 and pick 38 (see FIG. 1) contacts that string 22, the closed primary partial circuit completes an electrical circuit from power source 24 (see FIG. 1) to synthesizer 30 through one said secondary partial circuit 46 or 50, and generates an electrical signal causing synthesizer 30 to sound an individual musical tone.

Figure 4:
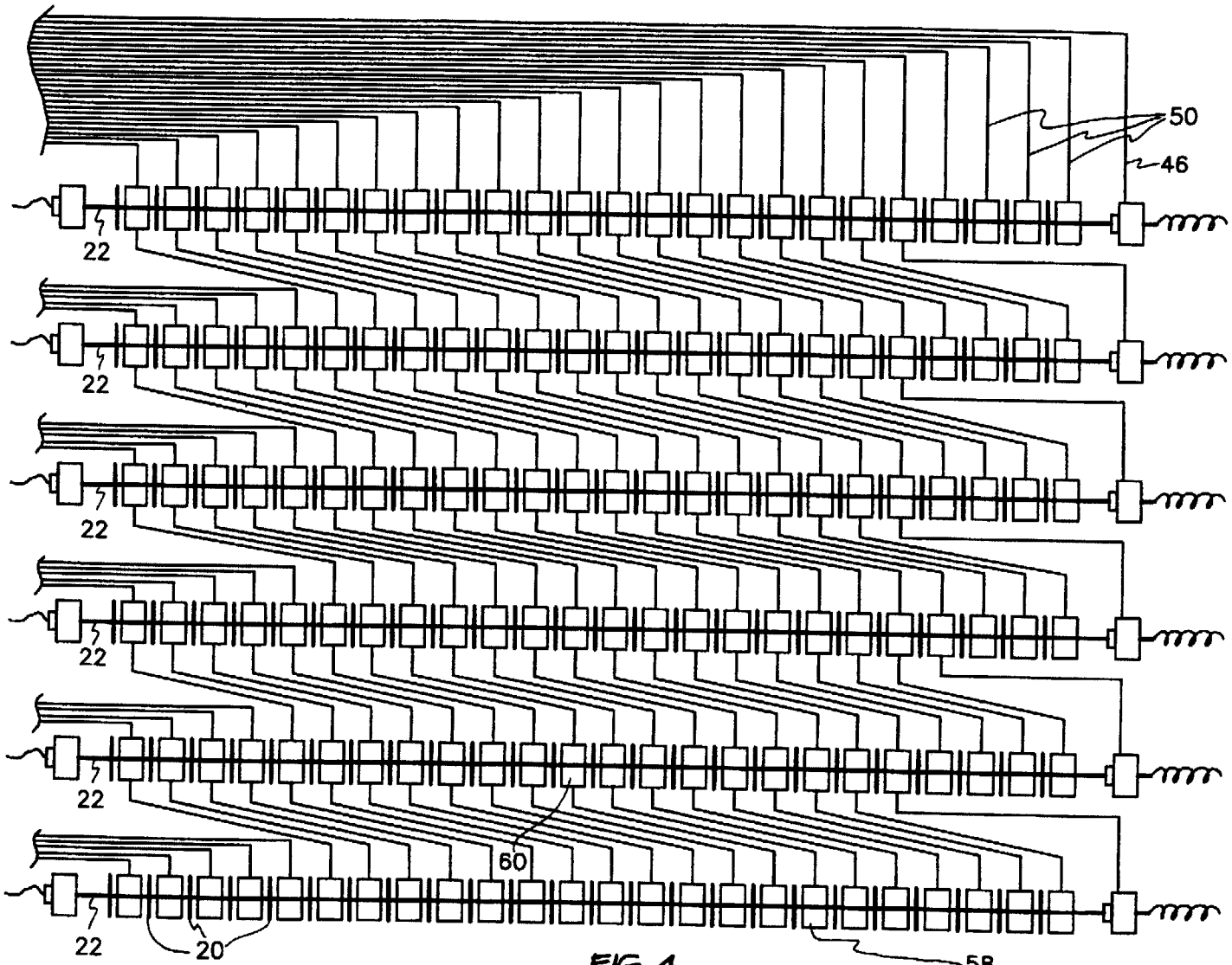
FIG. 4 is an exaggerated, top plan detail view of the neck of the novel musical instrument.

In an actual acoustic instrument, nominally identical musical tones may be sounded by different strings, when appropriately depressed and picked. The same characteristic is provided by instrument 10. This is accomplished by arranging some secondary partial circuits to duplicate one another, as illustrated in FIG. 4. It will be seen that contact members 58 and 60 correspond to the same musical tone. This effect is easily brought about by having the secondary partial circuits of nominally identical musical tones joined in common at appropriate signal circuits terminals (not shown) of synthesizer 30 (see FIG. 1).

Instrument 10 thus simulates string frequency characteristics of an array of strings of an acoustic counterpart. In particular, FIG. 4 emphasizes that in the preferred embodiment, instrument 10 simulates a six stringed acoustic guitar. To further this simulation instrument 10 has six strings 22 arranged abreast and parallel, twenty-four fret bars 20 disposed perpendicularly to and beneath strings 22, and twenty-four secondary partial circuits 46 or 50 for each one string 22.

While it would be possible that strings 22 include one straight section maintained under tension, in the manner of actual acoustic instruments, it is contemplated that in the present invention, it would be most feasible to separate strings 22 into two principal sections. Returning to FIG. 1, each string 22 has a first section 62 disposed substantially above body 12, for picking, and a second section 64, disposed substantially above fret bars 20, for depressing. First section 62 of each string 22 is secured under tension between two retainers 66, 68. Second sections 64 of each string are maintained under tension by securement at retainer 70 and at anchorage point 54 (see FIG. 2). Retainers 66, 68, 70 may include apparatus for pinching a string 22, for winding a string 22 thereon, or for maintaining securement and tension in any suitable way.

Electrical continuity of each string 22 in the preferred embodiment is maintained by an electrically conductive jumper 72 disposed in series between and connecting first section 62 and second section 64 of each string 22. Jumper 22 is relaxed from tension, so that tension of first section 62 may be established and adjusted separately from tension of second section 64.

It will occur to those of skill in the art that various modifications may be made to the embodiments described above. For example, power supply 24 and synthesizer 30 may be located either within body 12, or remotely therefrom. Also, the number of strings and secondary partial circuits may be varied according to the type of acoustic instrument being simulated, or according to any other scheme.

It is to be understood that the present invention is not limited to the embodiments described above, but encompasses any and all embodiments within the scope of the following claims.

I claim:

1. An electronic stringed instrument, comprising:

a body including a neck projecting from said body, said neck having disposed thereon a plurality of fret bars spaced apart from one another, said body having a plurality of electrically conductive strings extending along said neck and across said fret bars in spaced apart relationship;

a power source;

a musical tone synthesizer having means for generating diverse musical tones individually, responsive to different electrical signals, each signal corresponding to a predetermined individual tone; and an actuating circuit electrically connected to said power source and to said synthesizer, for generating different signals corresponding to predetermined musical tones, said actuating circuit further comprising a primary partial circuit including a flexible electrical conductor electrically connected to said power source and extending outside said body of said stringed instrument, and an electrically conductive pick electrically connected to said flexible electrical conductor, and a plurality of secondary partial circuits electrically connected to said synthesizer, each one partial circuit corresponding to an individual musical tone, an electrical contact member being disposed beneath each string and between two adjacent said fret bars, each one partial circuit having a conductor communicating electrically between an associated said contact member and said synthesizer so as to cause said synthesizer to sound a predetermined tone, each said secondary partial circuit being disposed serially with one string such that when said one string is depressed between two adjacent said fret bars and contacts a said contact member and said pick contacts said one string, said primary partial circuit completes an electrical circuit from said power source to said synthesizer through one said secondary partial circuit, and generates an electrical signal causing said synthesizer to sound an individual musical tone.

2. The electronic stringed instrument according to claim 1, further comprising means for maintaining said strings under tension, whereby said strings of said electronic stringed instrument simulate the feel of an acoustic counterpart of said electronic stringed instrument when said strings are depressed between adjacent said fret bars and are picked.

3. The electronic stringed instrument according to claim 1, said synthesizer having means for sounding identical musical tones when different said strings are depressed between different said fret bars and are picked, whereby said electronic stringed instrument simulates string frequency characteristics of an array of strings of an acoustic counterpart of said electronic stringed instrument.

4. The electronic stringed instrument according to claim 1, each said string having a first section for picking and means for maintaining said first section under tension, a second section for depressing, said second section disposed above said fret bars and having second means for maintaining said second section under tension, and an electrically conductive jumper electrically connecting said first section to said second section, said jumper being relaxed from tension, whereby tension of said first section may be established and adjusted separately from tension of said second section.

5. The electronic stringed instrument according to claim 1, said electronic stringed instrument having six strings arranged abreast and parallel, twenty-four fret bars disposed perpendicularly to and beneath said six strings, and twenty-four said secondary partial circuits for each one of said six strings, whereby said electronic instrument simulates a six string acoustic guitar.

6. An electronic stringed instrument, comprising:

a body including a neck projecting from said body, said neck having disposed thereon a plurality of electrically insulated fret bars spaced apart from one another, said body having a plurality of electrically conductive strings extending along said neck and across said fret bars in spaced apart relationship, each said string having a first section for picking and means for maintaining said first section under tension, a second section for depressing, said second section disposed above said fret bars and having second means for maintaining said second section under tension, and an electrically conductive jumper electrically connecting said first section to said second section, said jumper being relaxed from tension, whereby tension of said first section may be established and adjusted separately from tension of said second section, and said strings of said electronic stringed instrument simulate the feel of an acoustic counterpart of said electronic stringed instrument when said strings are depressed between adjacent said fret bars and are picked;

a power source;

a musical tone synthesizer having means for generating diverse musical tones individually, responsive to different electrical signals, each signal corresponding to a predetermined individual tone; and an actuating circuit electrically connected to said power source and to said synthesizer, for generating different signals corresponding to predetermined musical tones, said actuating circuit further comprising a primary partial circuit including a flexible electrical conductor electrically connected to said power source and extending outside said body of said stringed instrument, and an electrically conductive pick electrically connected to said flexible electrical conductor, and a plurality of secondary partial circuits electrically connected to said synthesizer, each one partial circuit corresponding to an individual musical tone, an electrical contact member being disposed beneath each string and between two adjacent said fret bars, each one partial circuit having a conductor communicating electrically between an associated said contact member and said synthesizer so as to cause said synthesizer to sound a predetermined tone, each said secondary partial circuit being disposed serially with one string such that when said one string is depressed between two adjacent said fret bars and contacts a said contact member and said pick contacts said one string, said primary partial circuit completes an electrical circuit from said power source to said synthesizer through one said secondary partial circuit, and generates an electrical signal causing said synthesizer to sound an individual musical tone, said synthesizer having means for sounding identical musical tones when different said strings are depressed between different said fret bars and are picked, whereby said electronic stringed instrument simulates string frequency characteristics of an array of strings of an acoustic counterpart of said electronic stringed instrument.

7. The electronic stringed instrument according to claim 6, said electronic stringed instrument having six strings arranged abreast and parallel, twenty-four fret bars disposed perpendicularly to and beneath said six strings, and twenty-four said secondary partial circuits for each one of said six strings, whereby said electronic instrument simulates a six string acoustic guitar.

* * * * *